United States Patent [19]

Tornay

[11] 4,194,870

[45] Mar. 25, 1980

[54] SLAM PREVENTION IN LIQUID PUMPING

[75] Inventor: Edmund G. Tornay, New York, N.Y.

[73] Assignee: Energy Transportation Group, Inc., New York, N.Y.

[21] Appl. No.: 887,084

[22] Filed: Mar. 16, 1978

[51] Int. Cl.[2] ..... F04B 15/08

[52] U.S. Cl. ..... 417/53; 417/543; 417/901; 62/45

[58] Field of Search ..... 417/543, 53, 901; 62/45, 55; 114/74 A

[56] References Cited

U.S. PATENT DOCUMENTS

| | | | |
|---|---|---|---|
| 1,364,680 | 1/1921 | Barton | 417/543 |
| 1,900,652 | 3/1933 | Logan | 417/543 |
| 2,315,179 | 3/1943 | Allender | 417/543 |
| 3,095,220 | 6/1963 | Johnston et al. | 417/901 |
| 3,742,727 | 7/1973 | Kaiser | 417/543 |
| 3,828,565 | 8/1974 | McCabe | 62/45 |
| 3,868,198 | 2/1975 | Purtell | 417/53 |

FOREIGN PATENT DOCUMENTS

| | | | |
|---|---|---|---|
| 236645 | 12/1961 | Australia | 417/543 |

*Primary Examiner*—William L. Freeh
*Attorney, Agent, or Firm*—William Drucker

[57] ABSTRACT

Conventional installations for pumping of liquid LNG (liquefied natural gas) from a sealed tank of a marine vessel to a shore installation commonly include a pump immersed in the liquid, a riser pipe from the pump to a level above the liquid, a stop valve on the riser pipe outside the tank, and a connection to the header leading to the shore installation. With the stop valve closed, operation of the pump can cause slamming of the liquid, accelerating up the riser pipe, against the stop valve, to the extent that the valve or piping may be damaged or destroyed. The invention provides a method of operation, and apparatus to permit it to be carried out, whereby a pocket of non-liquefiable gas is formed in the riser pipe above the liquid level so that, upon operation of the pump with the stop valve closed, although LNG vapor in the riser pipe may become compressed to liquid, the pocket of gas remains to act as a compressible buffer between the rising liquid and the stop valve.

5 Claims, 1 Drawing Figure

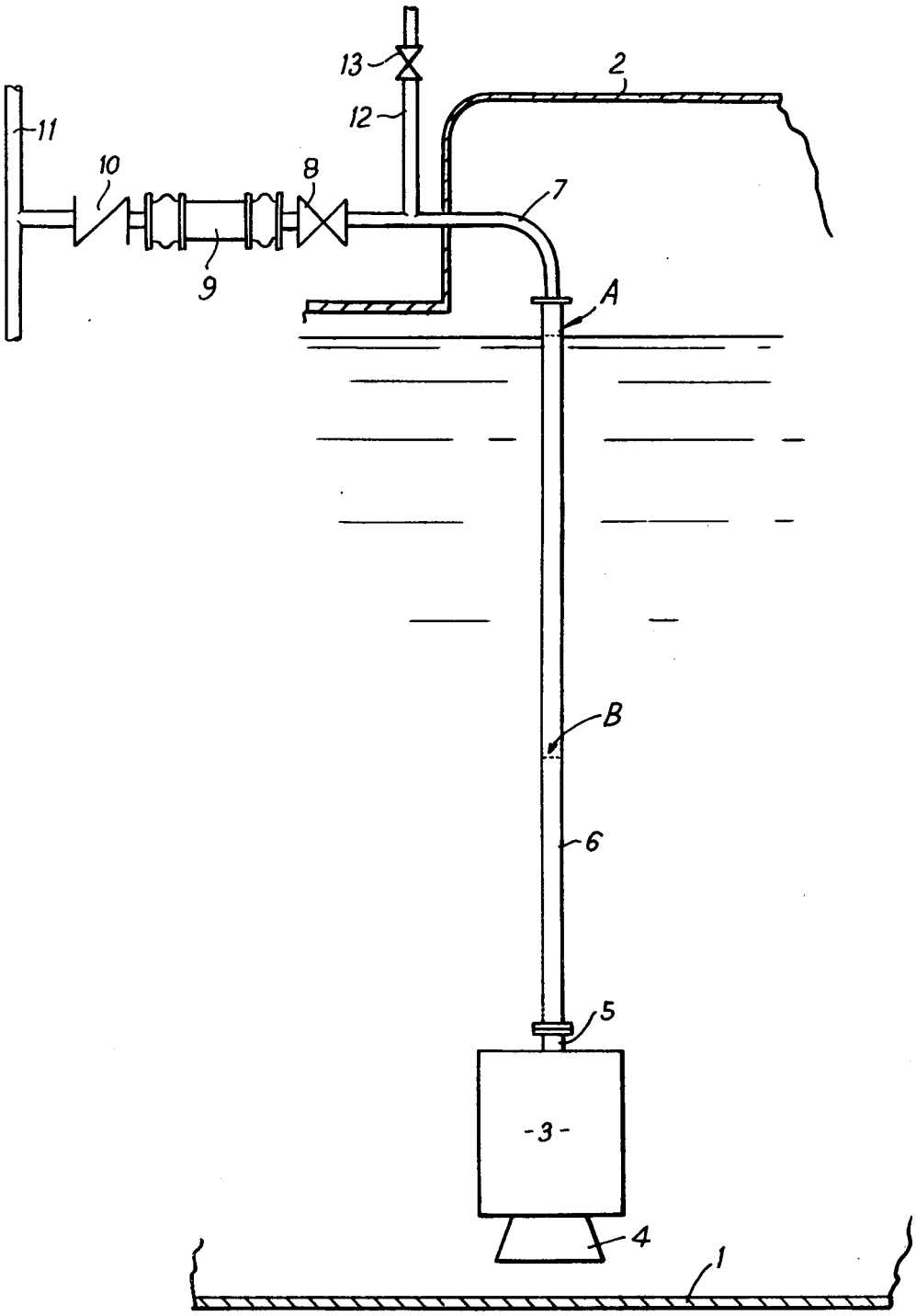
13
2
12
11
10
8
7
9
A
B
6
5
-3-
4
1

SLAM PREVENTION IN LIQUID PUMPING

BACKGROUND OF THE INVENTION

This invention relates to the pumping of liquids which would vaporise at normal temperature and pressure, hereinafter referred to as NTP. Such liquids therefore have to be stored, and pumped, at low temperatures and/or at pressures which are suitably greater than atmospheric. The invention is particularly applicable to, but is not restricted to, the pumping of liquefied natural gas, hereinafter referred to as LNG. It is frequently necessary to pump LNG from a tank to a receiver system, e.g. from a sealed tank of a marine vessel to a header leading to a shore installation. A conventional installation for this purpose commonly comprises a pump, such as a centrifugal pump, which is wholly immersed in the liquid in the tank. From the outlet of the pump a riser pipe rises to a point above the level of the liquid in the tank, and emerges externally of the upper part of the tank, e.g. the usual tank dome. A stop valve is fitted to the riser pipe, and a connection is made from the stop valve, e.g. through a flexible connection, to a header leading to a shore installation.

With the stop valve closed, and the system generally static, there will be a level of liquid in the riser pipe which is substantially the same as the level of the remainder of the liquid in the tank. The space within the riser pipe above the liquid level will be filled with the LNG vapor. If the pump is then operated, with the stop valve closed, the body of liquid accelerating up the riser pipe compresses the vapor and turns it to liquid. Accordingly, the advancing column of liquid reaches, and is substantially instantaneously checked by the stop valve. This abrupt impact is known in the art as valve "slam", and it can damage or destroy the stop valve or piping.

OBJECTS OF THE INVENTION

It is accordingly a first object of the invention to provided an improved method of operating such a pumping installation whereby pump slam is entirely eliminated.

A second object of the invention is to provide an improved installation, for the pumping of liquid in the manner described, with which the occurrence of pump slam may be avoided.

A third object is to provide a system, for the pumping of liquid LNG from a sealed tank of a marine vessel to a shore installation, with which pump slam may be avoided.

SUMMARY OF THE INVENTION

According to the present invention there is provided a method of operating a pumping installation, for a liquid which vaporises at NTP, having a pump with an inlet and an outlet and immersed in a body of liquid, a riser pipe connected at its lower end to the pump within the liquid and having its upper end above the liquid, and a stop valve at the upper end of the riser pipe. The method comprises the steps of:

(i) with the stop valve closed, injecting non-liquefiable gas into the riser pipe, so as to rest above the level of liquid therein, to force the liquid in the riser pipe to a level below that of the remainder of the body of liquid, (ii) with the stop valve closed, operating the pump to force liquid up the riser pipe until any vapor in the riser pipe has been turned to liquid and the non-liquefiable gas has become compressed.

(iii) opening the stop valve and continuing the operation of the pump to pump liquid from the body of liquid through the stop valve to a delivery point.

In this specification, the term "non-liquefiable gas" is intended to denote any gas which remains gaseous at any temperature within the intended temperature range of operation of the installation, and which remains gaseous under any pressure within the intended range of operational pressure of the installation and which can without disadvantage be contacted with the liquid to be pumped, e.g. in the case of pumping LNG the non-liquefiable gas could advantageously be nitrogen.

The non-liquefiable gas may advantageously be injected at a pressure calculated in relation to the density of the vaporisable liquid, for the purpose of obtaining a required lowering of the level of liquid in the riser pipe. Thus, by injecting the non-liquefiable gas into the riser pipe until there has been obtained a sufficient predetermined lowering of the liquid in the riser pipe, the pocket of gas which remains, after the vapor in the pipe has been turned to liquid, will prevent slam of the liquid in the riser pipe against the stop valve.

Further according to the invention, an installation, for pumping a liquid which vaporises at NTP, has:

(i) a pump, for immersion in a body of liquid to be pumped, said pump having an inlet and an outlet, (ii) a riser pipe having a lower end connected to the pump so as when the installation is operated, to be within the body of liquid, the riser pipe having an upper end which, when the installation is operated, is above the level of the body of liquid, and (iii) a stop valve communicating with the upper end of the riser pipe.

In such an installation the invention provides:

(a) an openable and closable inlet to the riser pipe;

(b) means for feeding to said inlet a non-liquefiable gas at a pressure suitable to force liquid in the riser pipe to a level lower than that of the remainder of the body of liquid.

A system for pumping liquid LNG from a sealed tank of a marine vessel to a shore installation may comprise:

(i) a liquid pump immersed in the liquid in the sealed tank, (ii) a riser pipe having its lower end communicating with the outlet of the pump and its upper end positioned above the level of liquid in the tank, (iii) a stop valve communicating with the upper end of the riser pipe, (iv) a flexible connection providing communication between the stop valve on the tank and a header pipe on the vessel leading to a shore connection.

(v) means, for injecting a non-liquefiable gas under pressure, including a shut-off valve communicating with the riser pipe.

In order that the nature of the invention may be readily ascertained an embodiment of apparatus and its method of operation in accordance with the invention are hereinafter particularly described with reference to the accompanying drawing.

BRIEF DESCRIPTION OF THE DRAWING

The drawing is a schematic elevation, with parts shown in section, of a tank of tanker vessel for LNG and its connections to a shore installation.

DESCRIPTION OF THE PREFERRED EMBODIMENT

The drawing shows a tank, of a tanker vessel, bounded by a tank bottom 1, a tank dome 2, and a side wall (not shown). Within the tank, at the lower part thereof, there is provided a centrifugal pump 3 having an inlet 4 and an outlet 5. The outlet 5 is connected to a riser pipe 6 leading to a neck 7 connected through a stop valve 8, a flexible connection 9, and a check valve 10 to a header pipe 11 leading to a shore tank installation.

Without the provisions of the present invention, the conventional manner of operation risks heavy impacting or "slamming" of the pumped liquid LNG against the intake of the stop valve 8. For example, assuming that there is a quantity of LNG vapor, and also a column of liquid LNG in the riser pipe 6, then at the time of commencement of operation of the pump the rising column of liquid in the pipe 6 will cause the collapse of the vapor pocket, with the result that the rising column of liquid will slam into the valve 8, with possible destruction or damage of the piping or valve.

In accordance with the invention there is provided a conduit 12 leading into the neck 7. The conduit 12 has a shut-off valve 13 which is connected to any convenient source of nitrogen gas under pressure, e.g. a cylinder or a storage tank. It will be appreciated that the conduit 12 may connect to any point of the riser pipe 6 provided that injected gas can rise to a position above the level of liquid in the riser pipe.

Assuming that stop valve 8 is closed, and that the liquid in riser pipe 6 is initially at level "A", the valve 13 is opened to admit nitrogen under pressure to force the liquid level in pipe 6 down to level "B". The valve 13 is then closed. The pump 3 is then started, and the accelerating column of liquid in pipe 6 compresses the gas and vapor pocket above it. The saturated LNG vapor in that space condenses, but the nitrogen does not condense. Accordingly, the column of liquid in pipe 6 rises until the pressure of the compressed nitrogen matches the pump shut-off head pressure. The pump may, in a manner well known in the art, have an automatic shut-off when a certain high pressure is reached at its outlet. Accordingly, the advancing column of liquid does not reach the stop valve 8, and valve slam is eliminated. The valve 8 can then be opened to permit restarting of the pump 3 and delivery of nitrogen gas and liquid LNG to the header 11.

The lowering of the level of the liquid in pipe 6 from level "A" to level "B" is advantageous because it is thereby possible to ensure that a sufficient amount of nitrogen gas is injected to induce the required cushioning effect.

By changing the level from "A" to "B" a specific adequate volume is obtained.

Since the density of LNG, in its liquid state, is known, nitrogen can be injected at a specific pressure to give repeatable reductions in level, and repeatable amounts of nitrogen present above the column of liquid in pipe 6. Thus, it is possible to make an experimental determination of the required amount of nitrogen injection required to prevent slamming, and to translate this amount in terms solely of nitrogen pressure. Since the density of liquid LNG is always between 0.43 and 0.5, this experimental determination of the required nitrogen injection pressure need only be carried out once or twice, and can thereafter be applied to pumping of all of the tanks of all ships with the same piping configuration.

I claim:

1. The method of operating a pumping installation for a liquid which vaporises at NTP, said installation having:

(a) a pump having an inlet and an outlet, said pump being immersed in a body of liquid;

(b) a riser pipe having a lower end connected to the pump within the body of liquid and having an upper end at a point above the level of the body of liquid, and (c) a stop valve communicating with the upper end of the riser pipe, said method comprising the steps of:

(i) with the stop valve closed, injecting non-liquefiable gas into the riser pipe to form a cushion of said gas in the riser pipe by forcing the liquid in the riser pipe down to a level below that of the remainder of the body of liquid, (ii) with the stop valve closed, operating the pump to force liquid up the riser pipe until any vapour in the riser pipe has been turned to liquid and the cushion of non-liquefiable gas has become further compressed, (iii) opening the stop valve and continuing the operation of the pump to pump liquid from the body of liquid through the stop valve to a delivery point.

2. In the method of claim 1, injecting the non-liquefiable gas at a pressure calculated in relation to the density of the vaporisable liquid, for the purpose of obtaining a required lowering of the level of liquid in the riser pipe.

3. In the method of claim 1, injecting the non-liquefiable gas into the riser pipe until there has been obtained a sufficient lowering of the liquid in the riser pipe such that the pocket of gas which remains, after the vapor in the pipe has been turned to liquid, will prevent slam of the liquid in the riser pipe against the stop valve.

4. In an installation for pumping a liquid which vaporises at NTP, said installation having:

(i) a pump, for immersion in a body of liquid to be pumped, said pump having an inlet and an outlet, (ii) a riser pipe having a lower end connected to the pump so as, when the installation is operated, to be within the body of liquid, the riser pipe having an upper end which, when the installation is operated, is above the level of the body of liquid, (iii) a stop valve communicating with the upper end of the riser pipe, the improvement which comprises:

(a) an openable and closable inlet to the riser pipe, (b) means for feeding into the riser pipe through said inlet a non-liquefiable gas at a pressure suitable to form a cushion of said gas in the riser pipe by forcing liquid in the riser pipe to a level lower than that of the remainder of the body of liquid.

5. In a system for pumping liquid LNG from a sealed tank of a marine vessel to a shore installation:

(i) a liquid pump to be immersed in the liquid in the sealed tank, (ii) a riser pipe having its lower end communicating with the outlet of the pump and its upper end positioned, when in use, above the level of the liquid in the tank, (iii) a stop valve communicating with the upper end of the riser pipe, (iv) a flexible connection providing communication between the stop valve on the tank and a header pipe on the vessel leading to a shore connection, (v) means, including a shut-off valve communicating with the riser pipe at a point of the riser pipe above the level of the liquid in the tank, for feeding into the riser pipe a non-liquefiable gas under a pressure suitable to form a cushion of said gas in the riser pipe by forcing liquid in the riser pipe down to a level lower than that of the remainder of the body of liquid.

* * * * *